US009476179B2

(12) United States Patent
Seljestad

(10) Patent No.: US 9,476,179 B2
(45) Date of Patent: Oct. 25, 2016

(54) EXCAVATOR THUMB TOOLBAR COUPLING SYSTEM

(71) Applicant: CATERPILLAR INC., Peoria, IL (US)

(72) Inventor: Gregory Allan Seljestad, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 15 days.

(21) Appl. No.: 14/575,891

(22) Filed: Dec. 18, 2014

(65) Prior Publication Data

US 2016/0177538 A1 Jun. 23, 2016

(51) Int. Cl.

| | |
|---|---|
| ***E02F 3/40*** | (2006.01) |
| ***E02F 3/413*** | (2006.01) |
| ***E02F 3/96*** | (2006.01) |

(52) U.S. Cl.

CPC ..... *E02F 3/404* (2013.01); *E02F 3/413* (2013.01); *E02F 3/963* (2013.01)

(58) Field of Classification Search

CPC ..... E02B 36/413; E02B 3/404; E02B 3/963
USPC ..... 414/724, 723; 37/403, 405, 406
See application file for complete search history.

(56) References Cited

U.S. PATENT DOCUMENTS

| | | | | |
|---|---|---|---|---|
| 6,857,843 | B2 | 2/2005 | Cummings | |
| 8,695,239 | B2 * | 4/2014 | Seda | E02F 3/404 37/406 |
| 9,151,012 | B2 * | 10/2015 | Seda | E02F 3/404 |
| 2002/0101107 | A1 * | 8/2002 | Cunningham | E02F 3/404 297/377 |
| 2003/0223852 | A1 | 12/2003 | Bauer et al. | |
| 2007/0289173 | A1 | 12/2007 | Riffle | |
| 2010/0058622 | A1 * | 3/2010 | Calvert | E02F 3/404 37/405 |
| 2013/0259627 | A1 | 10/2013 | Seljestad | |
| 2014/0007467 | A1 | 1/2014 | Kovar et al. | |

* cited by examiner

*Primary Examiner* — John G Weiss
(74) *Attorney, Agent, or Firm* — Procopio, Cory, Hargreaves & Savitch LLP

(57) ABSTRACT

A toolbar for a thumb assembly for a machine is disclosed. The toolbar includes a toolbar member, tooling joined to the toolbar member, a first toolbar plate and a second toolbar plate extending from opposite ends of the toolbar member. The first toolbar plate and the second toolbar plate each include a plate member connector joined to the toolbar member, a leaf arm, and a saddle extension. The leaf arm extends from the plate member connector. The saddle extension extends from the leaf arm proximal the plate member connector forming a post saddle for receiving a post of a thumb frame of the thumb assembly.

17 Claims, 5 Drawing Sheets

EXCAVATOR THUMB TOOLBAR COUPLING SYSTEM

TECHNICAL FIELD

The present disclosure generally pertains to a machine with a thumb assembly, and is directed toward a thumb assembly with a toolbar coupling system.

BACKGROUND

Mining and construction machines, such as excavators, hydraulic mining shovels, and backhoe loaders commonly employ an implement system including one or more articulable arms and a bucket pivotally attached to an articulable arm. Often, the implement system also includes a thumb. Generally a thumb is designed to match a particular bucket. The thumb may include a particular type of tooling, which may be integral to the thumb. An operator may need to store and maintain multiple thumbs for each bucket to accommodate the various tooling needed by the operator. Other thumbs may include removable tooling that may be time consuming and difficult to remove and replace.

U.S. Patent application No. 2014/0007467 to Kovar et al. discloses a counteracting thumb for an implement of a machine that includes first and second structure support plates each having first and second planar portions connected by an intermediate curved portion to orient the planar portions at an obtuse angle relative to each other. A first end edge of the first plate may be connected to an inner surface of the second plate proximate a first end edge of the second plate, and second end edge of the second plate may be connected to an inner surface of the first plate proximate a second end edge of the first plate. Side plates of the thumb may be connected to an outer surface of the first plate, and teeth of the thumb may be connected to an outer surface of the second plate.

The present disclosure is directed toward overcoming one or more of the problems discovered by the inventor.

SUMMARY OF THE DISCLOSURE

A thumb assembly for an implement system of a construction or mining machine is disclosed. In embodiments, the thumb assembly includes a thumb frame, a frame fastening portion, and a post. The thumb frame includes a toolbar saddle, a stick pin interface, a linkage interface, a frame fastening portion, and a post. The toolbar saddle is located at an end of the thumb frame and has a concave shape. The stick pin interface joins the thumb frame to a lifting arm of the machine. The stick pin interface is distal to the toolbar saddle and at an opposite end of the thumb frame. The linkage interface is located between the toolbar saddle and the stick pin interface. The frame fastening portion is joined to the thumb frame. The post is secured to the thumb frame near the toolbar saddle.

In embodiments, the thumb frame also includes a toolbar. The toolbar includes a toolbar member, tooling, and a toolbar plate. The toolbar member is located at least partially within the toolbar saddle and contacts the thumb frame at the toolbar saddle. The tooling extends from the toolbar member in a direction away from the thumb frame. The toolbar plate extends from the toolbar member and includes a post saddle and a toolbar fastening portion. The post saddle has a concave shape extending at least partially around the post. The post is seated at least partially within the post saddle. The toolbar fastening portion is joined to the toolbar plate and located distal to the toolbar member. The toolbar fastening portion is coupled to the frame fastening portion.

DETAILED DESCRIPTION

The systems and methods disclosed herein include a thumb assembly with a thumb frame and a toolbar. In embodiments, the thumb frame includes a toolbar saddle and a post near the toolbar saddle. The toolbar includes a toolbar member located at least partially within the saddle and a toolbar plate extending from the toolbar member. The toolbar plate includes a post saddle with a concave shape that extends at least partially around the post so that the post is seated within the post saddle. The end of the toolbar plate distal to the toolbar member is fastened to the thumb frame. The configuration of the toolbar saddle, the post saddle, the toolbar member, and the post may allow the toolbar to be quickly and easily removed from the thumb frame by unfastening the end of the toolbar plate from the thumb frame and slightly rotating the toolbar to unseat the post from the post saddle, which allows the toolbar member to be removed from the toolbar saddle. The thumb assembly with a removable toolbar may also allow an operator to maintain an inventory of toolbars with differing tooling while reducing the overall size of the operator's inventory.

Figure 1:
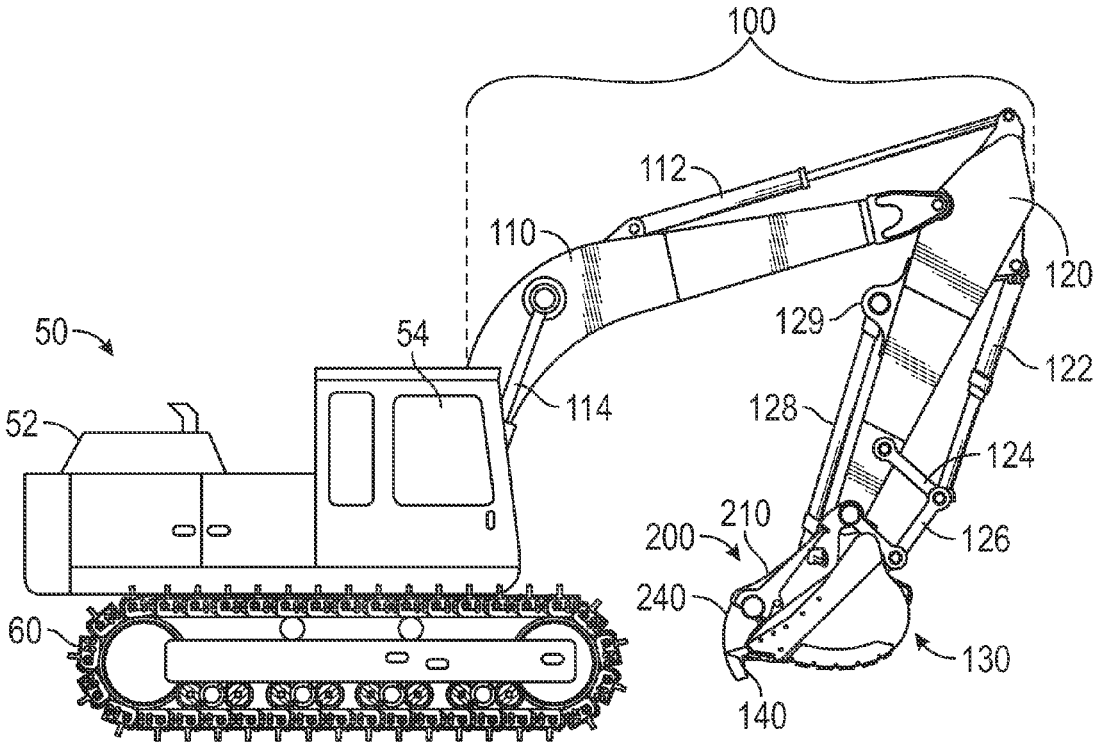
FIG. 1 is a diagrammatic side elevational view of an embodiment of a machine including an implement system with a thumb assembly.

FIG. 1 is a diagrammatic side elevational view of an embodiment of a machine 50 including an implement system 100 with a thumb assembly 200. The term "machine" may refer to any machine that performs some type of operation associated with an industry such as mining or construction, or any other industry known in the art, such as an excavator, a hydraulic mining shovel, backhoe loaders, or the like. In the embodiment illustrated, the machine 50 is an excavator.

The machine 50 may include a machine body 52, a drive system 60, and an implement system 100. The machine body 52 may include a cab 54 to house a machine operator and a power source (not shown), such as an engine. Drive system 60 may be an undercarriage track system, a wheel-drive system, or any other type of drive system 60 to propel the machine 50.

In the embodiment illustrated, the implement system 100 includes a boom 110, a lifting arm 120, a bucket 130, and a thumb assembly 200. Other configurations of the implement system 100 may also be used. For example, other ground engaging tools, such as rakes, may be used in place of the bucket 130. The boom 110 is generally pivotally attached to the machine body 52. The position of the boom 110 relative to the machine body 52 may be controlled by a boom hydraulic system 114. The boom hydraulic system 114 may be driven by the power source.

Figure 2:
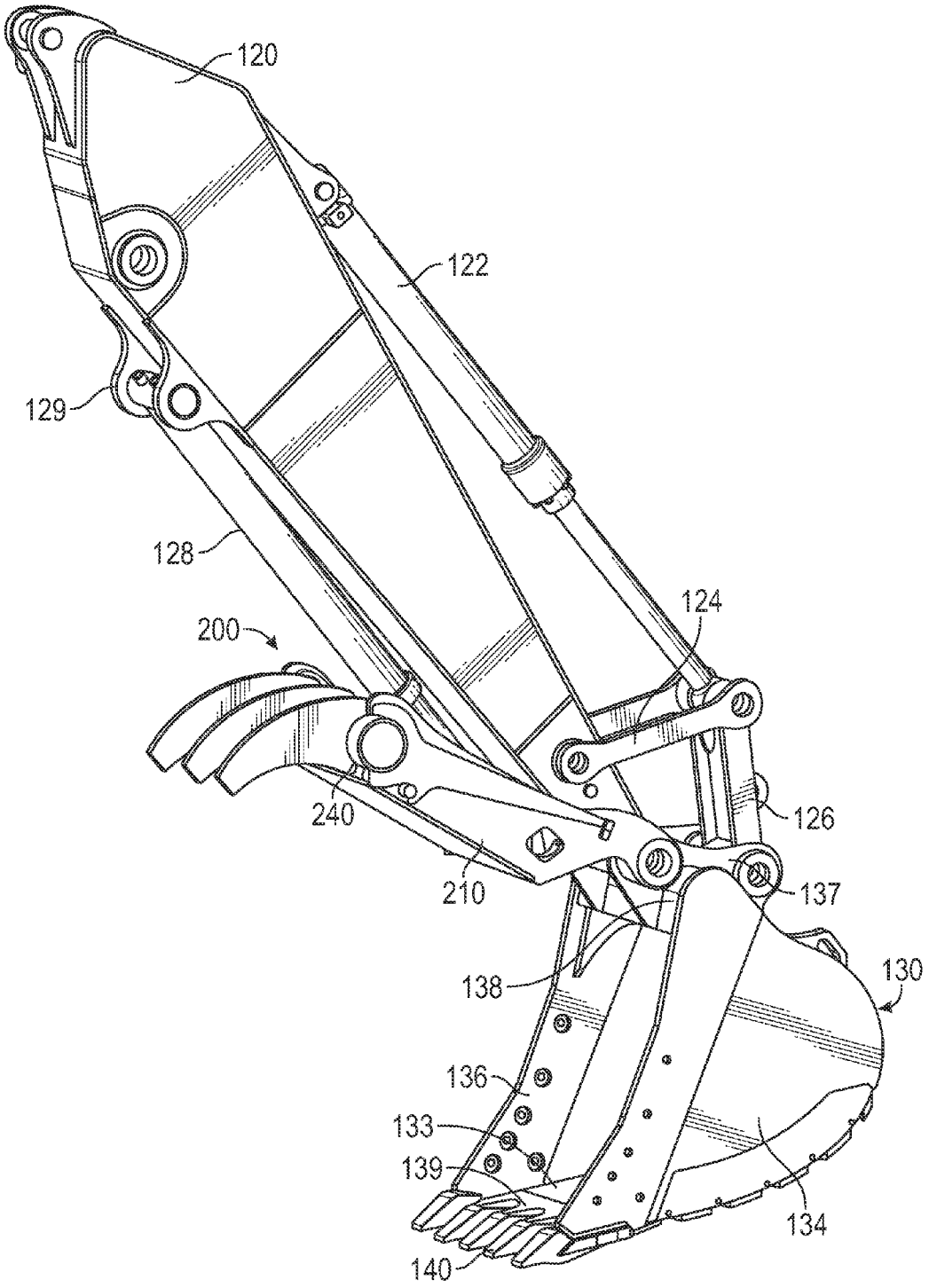
FIG. 2 is a perspective view of the lifting arm with the bucket and thumb assembly of FIG. 1.

FIG. 2 is a perspective view of the lifting arm 120 with the bucket 130 and thumb assembly of FIG. 1. Referring to FIGS. 1 and 2, lifting arm 120 is generally pivotally attached to boom 110 distal to the attachment between boom 110 and machine body 52. The position of lifting arm 120 relative to boom 110 may be controlled by an arm hydraulic system 112. Arm hydraulic system 112 may also be driven by the power source.

Bucket 130 is generally pivotally attached to lifting arm 120 distal to the attachment between lifting arm 120 and boom 110. The positioning of bucket 130 relative to lifting arm 120 may be controlled by a bucket hydraulic system 122. Bucket hydraulic system 122 may also be driven by the power source. Bucket hydraulic system 122 may connect to lifting arm 120 proximal the connection between lifting arm 120 and boom 110. Bucket hydraulic system 122 may also connect to bucket 130. In some embodiments, bucket hydraulic system 122 is connected directly to bucket 130. In other embodiments, bucket hydraulic system 122 is connected to bucket 130 via a linkage system. In the embodiment illustrated, the linkage system includes arm linkage members 124 and bucket linkage members 126. Arm linkage members 124 may connect bucket hydraulic system 122 to lifting arm 120 proximal bucket 130. Bucket linkage members 126 may connect bucket hydraulic system 122 to bucket 130. Arm linkage members 124 and bucket linkage members 126 may pivotally connect to bucket hydraulic system 122 at the same location.

Bucket 130 may include a wrapper plate 133, an edge plate 139, a first bucket side wall 134, a second bucket side wall 136, and tooth assemblies 140. Wrapper plate 133 may be a curved portion of bucket 130. Edge plate 139 is adjacent wrapper plate 133 and may be metallurgically bonded, such as welded, to wrapper plate 133. The first bucket side wall 134 connects to one side of wrapper plate 133 and edge plate 139, and the second bucket side wall 136 connects to the other side of wrapper plate 133 and edge plate 139. Each tooth assembly 140 may connect to edge plate 139.

Bucket 130 may also include torque tube 138 and hinge plates 137. Torque tube 138 may extend between first bucket side wall 134 and second bucket side wall 136 distal to edge plate 139. Hinge plates 137 may be connected to torque tube 138. Hinge plates 137 may be configured to connect bucket 130 to lifting arm 120 and to bucket linkage members 126. The position of bucket 130 relative to lifting arm 120 may be controlled by bucket hydraulic system 122.

Thumb assembly 200 is also generally pivotally attached to lifting arm 120 distal to the attachment between lifting arm 120 and boom 110. In the embodiment illustrated, thumb assembly 200 is attached to lifting arm at the same location as bucket 130. The position of thumb assembly 200 relative to bucket 130 and to lifting arm 120 may be controlled by a thumb hydraulic system 128. Thumb hydraulic system 128 may be connected to lifting arm 120 at one end, such as by a bracket 129, and is connected to thumb assembly 200. In the embodiment illustrated, thumb hydraulic system 128 is connected directly to thumb assembly 200. In other embodiments, thumb hydraulic system 128 connects to thumb assembly 200 via linkage members, similar to bucket linkage members. The linkage members may increase the rotation range of thumb assembly 200 relative to bucket 130. Thumb hydraulic system 128 may also be driven by the power source.

Figure 3:
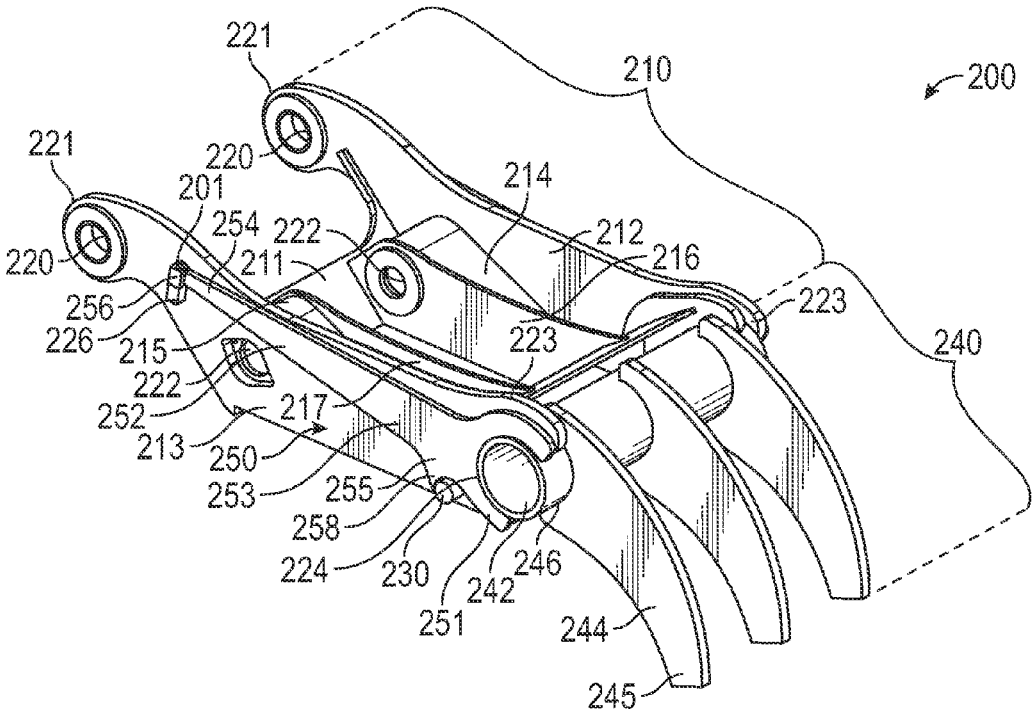
FIG. 3 is a perspective view of the thumb assembly of FIG. 2.
Figure 4:
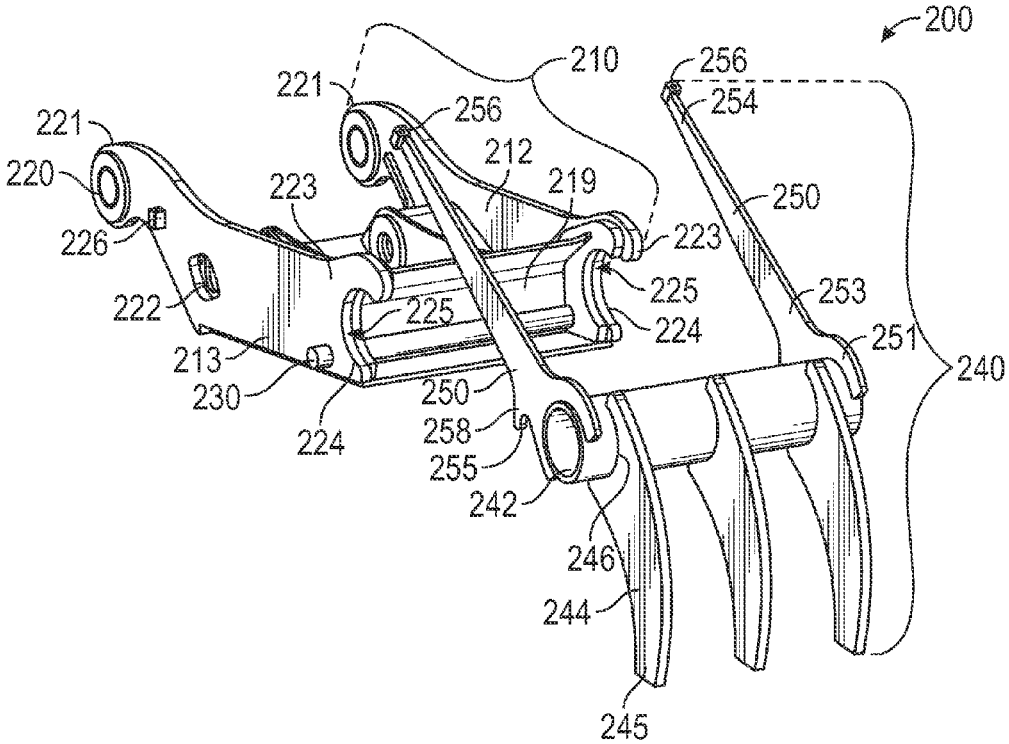
FIG. 4 is an exploded view of the thumb assembly of FIG. 3.

FIG. 3 is a perspective view of the thumb assembly 200 of FIG. 2. FIG. 4 is an exploded view of the thumb assembly 200 of FIG. 3. Referring to FIGS. 3 and 4, thumb assembly 200 includes a thumb frame 210, a post 230, and a toolbar 240. Thumb frame 210 includes a toolbar saddle 224, a stick pin interface 220, a linkage interface 222, and one or more frame fastening portions 226.

Toolbar saddle 224 is located proximal an end of the thumb frame 210 and may be at the end of thumb frame 210. Toolbar saddle 224 is configured to receive toolbar 240. Toolbar saddle 224 may have a concave shape. Toolbar saddle 224 may include one or more saddle surface 225. Saddle surface 225 may be a curved surface, such as a portion of a cylinder, a hyperbolic paraboloid, and the like, for receiving toolbar 240 and so that toolbar 240 can rotate while located within toolbar saddle 224 during assembly. Saddle surface 225 may recess into the thumb frame 210 with a concave shape to form the toolbar saddle 224.

Stick pin interface 220 may be located proximal the opposite end of thumb frame 210 relative to toolbar saddle 224 and may be located distal to toolbar saddle 224. Stick pin interface 220 may be used for coupling thumb frame 210 to lifting arm 120. Stick pin interface 220 may be one or more holes in the thumb frame 210 configured to receive a cylindrical pin.

Linkage interface 222 may be located between stick pin interface 220 and toolbar saddle 224. In the embodiment illustrated, linkage interface 222 is located closer to stick pin interface 220 than to toolbar saddle 224. Linkage interface 222 may be used to secure thumb frame 210 to thumb hydraulic system 128, which may be used to move thumb assembly 200 relative to bucket 130. Linkage interface 222 may be one or more holes in thumb frame 210 configured to receive a cylindrical pin.

Each frame fastening portion 226 is configured to couple, such as by bolting, a toolbar fastening portion 256 (described below) of toolbar 240 to thumb frame 210. A frame fastening portion 226 may be metallurgically bonded, such as welded, to thumb frame 210. Alternatively, it can be formed as part of the thumb frame 210. In the embodiment illustrated, frame fastening portion 226 is a threaded block and is configured to receive a threaded end of a bolt.

In embodiments, such as the embodiment illustrated, thumb frame 210 includes a first thumb side wall 212, a second thumb side wall 213, and a support plate 211. First thumb side wall 212 and second thumb side wall 213 may each be a plate forming a side of thumb frame 210. First thumb side wall 212 and second thumb side wall 213 may each include a pivot end 221 and a saddle end 223. Each pivot end 221 may include a bore extending there through as part of stick pin interface 220. For each side wall, the saddle end 223 is distal to the pivot end 221. Each saddle end 223 may include a saddle surface 225 and may form a portion of toolbar saddle 224. First thumb side wall 212 and second thumb side wall 213 may also include a bore located between pivot end 221 and saddle end 223 forming a portion of linkage interface 222. First thumb side wall 212 and second thumb side wall 213 may be symmetrical. The frame fastening portion 226 may be metallurgically bonded to first thumb side wall 212 between stick pin interface 220 and linkage interface 222, and a frame fastening portion 226 may be metallurgically bonded to second thumb side wall 213 between stick pin interface 220 and linkage interface 222.

Support plate 211 extends between first thumb side wall 212 and second thumb side wall 213 and across the width of thumb frame 210. Support plate 211 may structurally join first thumb side wall 212 and second thumb side wall 213 together.

In the embodiment illustrated, thumb frame 210 also includes first yoke plate 216, second yoke plate 217, first yoke support plate 214, second yoke support plate 215, and saddle plate 219. First yoke plate 216 and second yoke plate 217 may be symmetrically located between first thumb side wall 212 and second thumb side wall 213. First yoke plate 216 may be proximal first thumb side wall 212 and second yoke plate 217 may be proximal second thumb side wall 213. First yoke plate 216 and second yoke plate 217 may each include a bore that forms a portion of linkage interface 222. A connection end of thumb hydraulic system 128 may be located between first yoke plate 216 and second yoke plate 217 adjacent linkage interface 222 where a pin couples thumb hydraulic system 128 to thumb plate 240.

First yoke support plate 214 may extend between first thumb side wall 212 and first yoke plate 216 and may curve around the bores forming a portion of linkage interface 222. First yoke support plate 214 may structurally join first thumb side wall 212 to first yoke plate 216 near the linkage interface 222 and may provide structural support for linkage interface 222. First yoke support plate 214 may also connect to a portion of support plate 211 between linkage interface 222 and toolbar saddle 224. Second yoke support plate 215 may extend between second thumb side wall 213 and second yoke plate 217 and may curve around the bores forming the other portion of linkage interface 222. Second yoke support plate 215 may structurally join second thumb side wall 213 to second yoke plate 217 near the linkage interface 222 and may provide structural support for linkage interface 222. Second yoke support plate 215 may also connect to a portion of support plate 211 between linkage interface 222 and toolbar saddle 224. First yoke support plate 214 and second yoke support plate 215 may also be symmetrical.

Saddle plate 219 may extend between the saddle ends 223 of first thumb side wall 212 and second thumb side wall 213 adjacent to toolbar saddle 224. Saddle plate 219 may provide structural support for toolbar saddle 224. Saddle plate 219 may also connect to support plate 211 along the end of support plate 211 near the saddle ends 223.

Post 230 is secured to thumb frame 210 between toolbar saddle 224 and linkage interface 222. Post 230 may be located closer to toolbar saddle 224 than to linkage interface 222, such as proximal toolbar saddle 224. In the embodiment illustrated, post 230 is a cylinder extending between first thumb side wall 212 and second thumb side wall 213. Post 230 may also extend through and protrude from both first thumb side wall 212 and second thumb side wall 213. Post 230 may be configured to receive some of the load from toolbar 240 when toolbar 240 is used.

Toolbar 240 includes a toolbar member 242, tooling 244, and one or more toolbar plates 250. Toolbar member 242 is configured to assemble into toolbar saddle 224 and is configured to at least partially rotate into an assembled position within toolbar saddle 224. Toolbar member 242 contacts thumb frame 210 at saddle surface 225.

Toolbar member 242 may have an elongated shape and may have a length greater than the width of thumb frame 210, the width of thumb frame 210 being the distance from the outer surface of first thumb side wall 212 to the outer surface of second thumb side wall 213. Toolbar member 242 may be a solid bar or a hollow tube, such as a cylindrical tube. In some embodiments, toolbar member 242 is a hollow tube with capped ends. In the embodiment illustrated, toolbar member 242 is a hollow tube with uncapped ends. In some embodiments, at least the portion of the toolbar member 242 that contacts saddle surface(s) 225 during assembly is rounded. In the embodiment illustrated, toolbar member 242 has a circular cross-section. In other embodiments, toolbar member 242 has a polygonal, such as square, rectangular, or hexagonal cross-section.

Tooling 244 is joined to toolbar member 242. Tooling 244 may be joined to toolbar member 242 by a metallurgical bond, such as a weld, by fasteners, such as bolts, or by other methods. Tooling 244 extend from toolbar member 242. Tooling 244 may be a ground engaging implement. The ground engaging implement may include, inter alia, teeth, tines, or fingers. Each implement may include a tooling tip 245 configured to engage the ground or other materials to be moved or collected by bucket 130. Tooling 244 may be arranged to interlace with tooth assemblies 140 of bucket 130.

Toolbar plate 250 may be joined to toolbar member 242 by a metallurgical bond, such as a weld. Toolbar plate 250 may generally extend in a direction opposite tooling 244. Toolbar plate 250 includes a plate member connector 251, leaf arm 252, a post saddle 255, and a toolbar fastening portion 256. Plate member connector 251 may have a recess the shape of toolbar member 242. Toolbar plate 250 may be metallurgically bonded to toolbar member 242 at plate member connector 251.

Leaf arm 252 extends from plate member connector 251. Leaf arm 252 includes a leaf arm first end 253 and a leaf arm second end 254. Leaf arm first end 253 may be adjacent plate member connector 251 and leaf arm second end 254 may be distal plate member connector 251. Leaf arm 252 may taper such that the height of leaf arm 252 is narrower at leaf arm second end 254 than the height at leaf arm first end 253. In some embodiments, leaf arm 252 tapers at a constant rate. In other embodiments, leaf arm 252 tapers at a variable rate.

Post saddle 255 may be located adjacent toolbar member 242, such as at or near leaf arm first end 253. Post saddle 255 is configured to receive post 230 and to transfer at least a portion of the load applied to the toolbar 240 at tooling 244 to post 230 during operation of the thumb assembly 200. Post saddle 255 may have a concave shape and may extend at least partially around post 230 when toolbar 240 is assembled with thumb frame 210. Post saddle 255 may include a saddle extension 258 extending from leaf arm 252 to form shape of post saddle 255 for receiving post 230. Saddle extension 258 may be proximal plate member connector 251. In the embodiment illustrated, post saddle 255 is a curved recess that receives post 230.

Toolbar fastening portion 256 is configured to fasten toolbar 240 to thumb frame 210. Toolbar fastening portion 256 is located distal to toolbar member 242 and may be joined to leaf arm 252 by a metallurgical bond, such as a weld, at leaf arm second end 254. In the embodiment illustrated, toolbar fastening portion 256 is a clearance block configured to receive a bolt.

INDUSTRIAL APPLICABILITY

Machines, such as excavators, hydraulic mining shovels, and backhoe loaders are commonly used in the construction and mining industries to dig, excavate, move, and load materials, such as rock soil, overburden, and ore during mining and construction processes. Each of these machines may have various configurations for the implement systems including any number of thumbs. An operator may use the implement system for various operations and may have a need for more than one type of tooling on the thumb. Buckets may vary in size and the thumbs for one bucket may not be compatible with the thumbs for another bucket. Maintaining an inventory of buckets with compatible thumbs and the time required to swap the thumb being used may be expensive for an operator.

The thumb assembly 200 as disclosed herein may reduce the amount of inventory to be stored by an operator and may reduce the time required to change the tooling 244, reducing the operation costs of the operator. Storing a set of toolbars 240 with the tooling needed may take up much less space than storing the same number of thumbs with the tooling needed. As described below, thumb assembly 200 only requires swapping out a toolbar 240 rather than swapping out the entire thumb.

Figure 5:
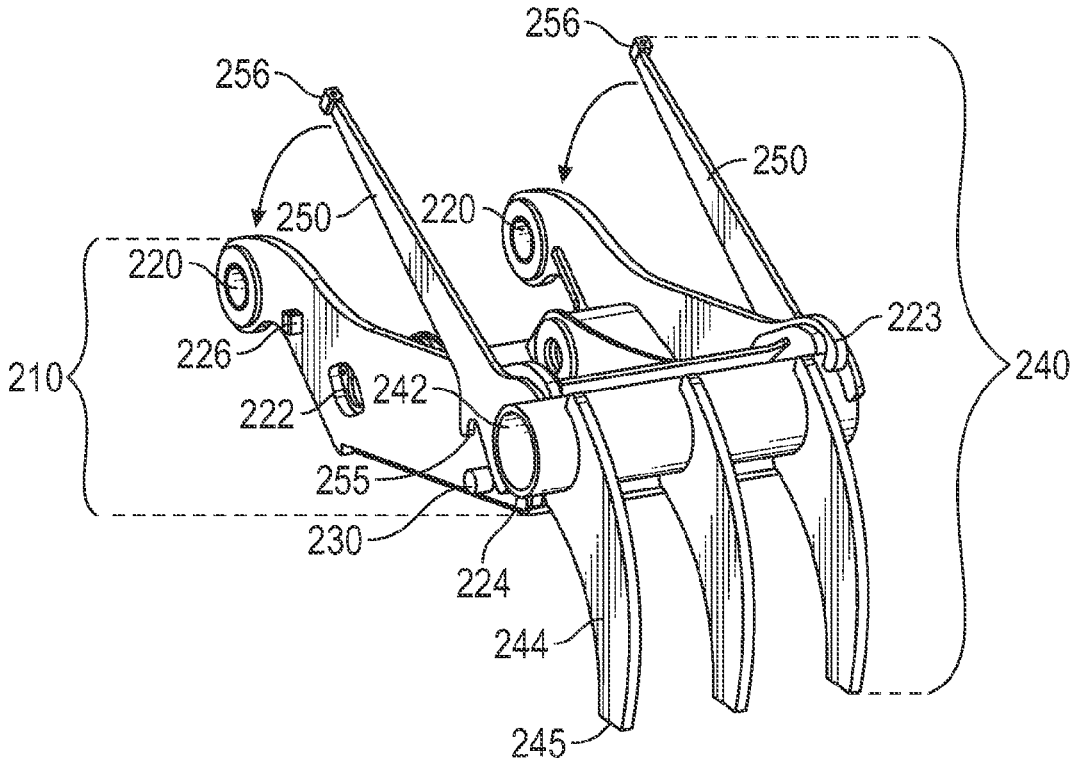
FIG. 5 is a perspective view of the thumb assembly of FIG. 3 partially assembled.
Figure 6:
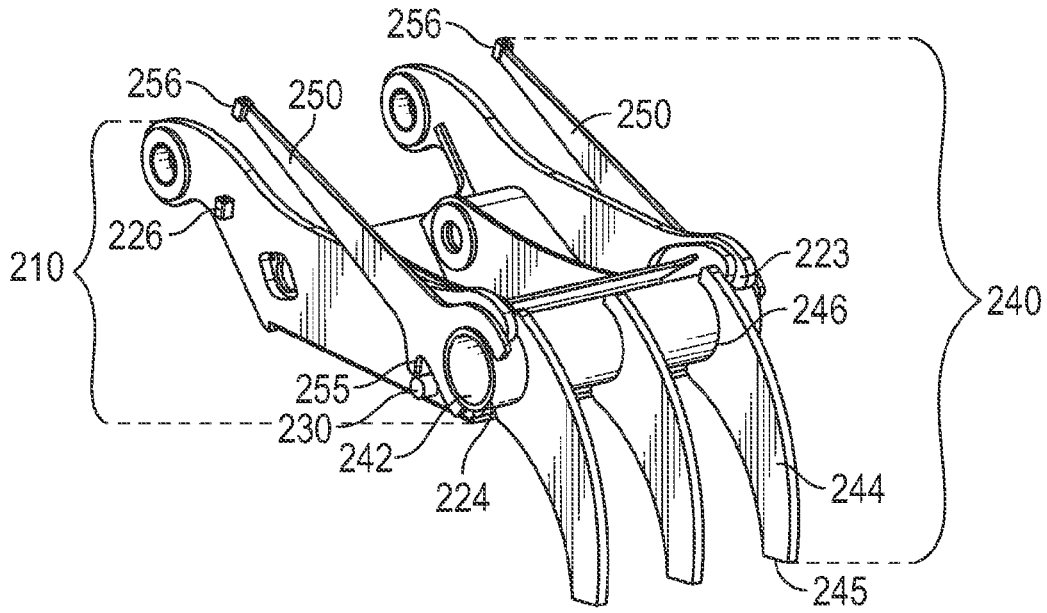
FIG. 6 is a perspective view of the thumb assembly of FIG. 3 partially assembled.
Figure 7:
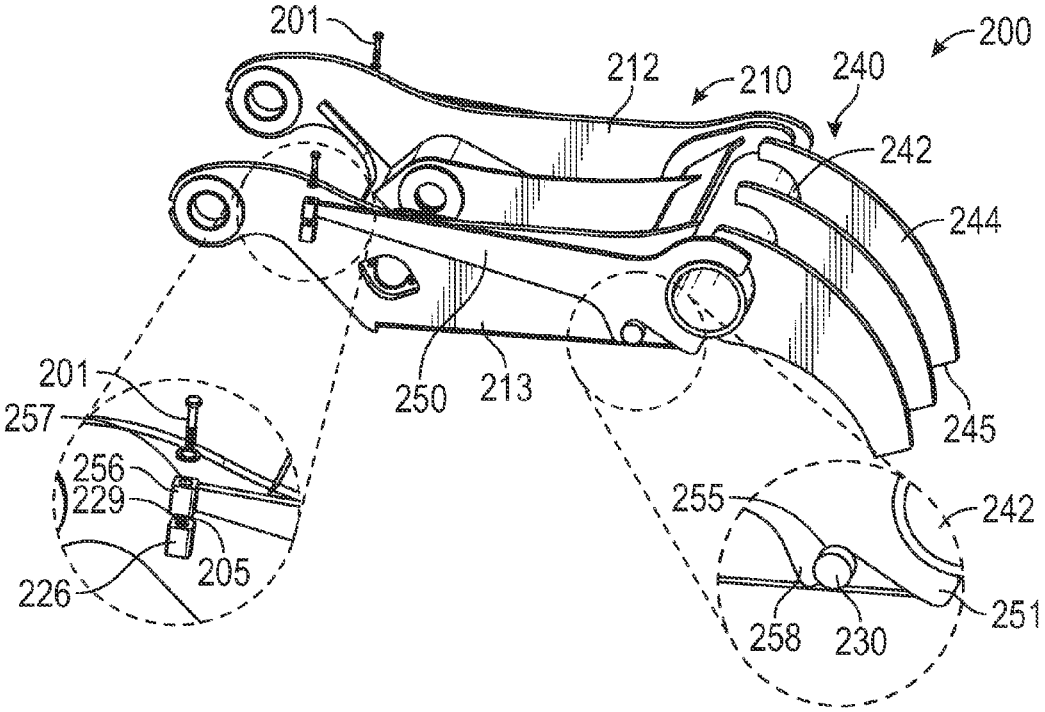
FIG. 7 is a perspective view of the thumb assembly of FIG. 3 partially assembled.

FIGS. 5, 6, and 7 are perspective views of the thumb assembly 200 of FIG. 3 in various stages of assembly. FIGS. 5, 6, and 7 demonstrate the method used to assemble a toolbar 240 to the thumb frame 210. As illustrated in FIG. 5, toolbar member 242 of toolbar 240 is located within toolbar saddle 224 so that toolbar member 242 is contacting the one or more saddle surfaces 225 (Refer to FIG. 4 for location of saddle surfaces 225). Toolbar 240 is positioned so that post saddle 255 is spaced apart from post 230 and toolbar fastening portion 256 is spaced apart from frame fastening portion 226. As illustrated by FIGS. 5, 6, and 7, toolbar 240 is rotated so that post 230 is seated within post saddle 255 (as shown in FIG. 7) and so that toolbar fastening portion 256 is adjacent frame fastening portion 226. The rotation may occur about an axis of toolbar member 242.

Referring to FIG. 7, prior to bolting the adjacent toolbar fastening portion 256 and frame fastening portion 226 together there may be a gap 205 there between when post 230 is seated within post saddle 255. When toolbar fastening portion 256 and frame fastening portion 226 are fastened together, gap 205 may be closed. When gap 205 is closed, post 230 may act as a fulcrum for toolbar plate 250, which may cause leaf arm 252 to act as a spring that applies a biasing load to the toolbar member 242 that keeps toolbar 240 tight within toolbar saddle 224.

Toolbar fastening portion 256 may include a clearance bore 257 extending through toolbar fastening portion 256, and frame fastening portion 226 may include a threaded hole 229 extending into frame fastening portion 226 that is configured to receive the threaded end of a fastener 201, such as a bolt. The taper in leaf arm 252 may facilitate some flexibility in leaf arm 252. The flexibility may allow the fastening of toolbar fastening portion 256 to frame fastening portion 226 even with some misalignment of clearance bore 257 and threaded hole 229, which may increase the ease of assembly reducing assembly times and costs. The misalignment tolerances may also allow toolbar plate 250 to be flame cut during the manufacturing process, which may reduce the cost of manufacturing.

The preceding detailed description is merely exemplary in nature and is not intended to limit the invention or the application and uses of the invention. The described embodiments are not limited to use in conjunction with a particular type of machine. Hence, although the present disclosure, for convenience of explanation, depicts and describes particular implement system, it will be appreciated that the thumb frame assembly in accordance with this disclosure can be implemented in various other configurations and can be used in other types of implement systems. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A thumb assembly for an implement system of a machine, the thumb assembly comprising:
- a thumb frame including
  - a toolbar saddle located proximal an end of the thumb frame, the toolbar saddle having a first concave shape,
  - a stick pin interface for coupling the thumb frame to a lifting arm of the machine, the stick pin interface being distal to the toolbar saddle and proximal an opposite end of the thumb frame, and
  - a linkage interface located between the toolbar saddle and the stick pin interface;
- a frame fastening portion joined to the thumb frame;
- a post secured to the thumb frame between the toolbar saddle and the linkage interface; and
- a toolbar including
  - a toolbar member located at least partially within the toolbar saddle, the toolbar member contacting the thumb frame at the toolbar saddle,
  - tooling extending from the toolbar member in a direction away from the thumb frame,
  - a toolbar plate having a first and a second end, the toolbar plate extending from the toolbar member at the first end, the toolbar plate including
    - a post saddle with a second concave shape positioned proximal to the first end and extending at least partially around the post and the post being seated at least partially within the post saddle, and
  - a toolbar fastening portion joined to the toolbar plate at the second end and located distal to the toolbar member, the toolbar fastening portion being coupled to the frame fastening portion.

2. The thumb assembly of claim 1, wherein there is a gap between the frame fastening portion and the toolbar fastening portion when the post is seated at least partially within the post saddle prior to coupling the toolbar fastening portion to the frame fastening portion.

3. The thumb assembly of claim 1, wherein the toolbar is assembled to the thumb frame such that the toolbar plate applies a biasing load to the toolbar member when the toolbar fastening portion is fastened to the frame fastening portion.

4. The thumb assembly of claim 1, wherein the toolbar plate further comprises:
- a plate member connector metallurgically bonded to the toolbar member; and
- a leaf arm extending from the plate member connector, the leaf arm including
  - a leaf arm first end adjacent the plate member connector, and
  - a leaf arm second end distal to the plate member connector;
- wherein the toolbar fastening portion is metallurgically bonded to the leaf arm at the leaf arm second end.

5. The thumb assembly of claim 4, wherein the leaf arm tapers such that a height of the leaf arm is narrower at the leaf arm second end than at the leaf arm first end.

6. The thumb assembly of claim 1, further comprising:
- a second frame fastening portion joined to a side of the thumb frame and the frame fastening portion being joined to an opposite side of the thumb frame;
- wherein the toolbar includes a second toolbar plate extending from an end of the toolbar member and a second toolbar fastening portion joined to the second toolbar plate distal to the toolbar member;

wherein the toolbar plate extends from an opposite end of the toolbar member relative to the second toolbar plate; and wherein the second toolbar fastening portion is coupled to the second frame fastening portion.

7. The thumb assembly of claim 1, wherein the thumb frame includes a first thumb side wall, a second thumb side wall, and a support plate extending between the first thumb side wall and the second thumb side wall; wherein the first thumb side wall and the second thumb side wall each include a pivot end that includes a hole forming a portion of the stick pin interface and a saddle end distal to the pivot end, the saddle end including a saddle surface forming a part of the toolbar saddle; and wherein the toolbar member contacts the thumb frame at the saddle surface of the first thumb side wall and the second thumb side wall.

8. The thumb assembly of claim 1, wherein the toolbar member is a cylindrical tube.

9. A toolbar for a thumb assembly of an implement system for use with a machine, the toolbar comprising:

a toolbar member including an elongated shape;

tooling extending from the toolbar member and joined to the toolbar member;

a first toolbar plate extending from an end of the toolbar member, the first toolbar plate including a first plate member connector joined to the toolbar member, a first leaf arm extending from the first plate member connector, the first leaf arm including a first leaf arm first end adjacent the first plate member connector and a first leaf arm second end distal to the first plate member connector, and a first saddle extension extending from the first leaf arm proximal the first plate member connector forming a first post saddle with a first concave shape for receiving a post of a thumb frame of the thumb assembly;

a second toolbar plate extending from an opposite end of the toolbar member, the second toolbar plate including a second plate member connector joined to the toolbar member, a second leaf arm extending from the second plate member connector, the second leaf arm including a second leaf arm first end adjacent the second plate member connector and a second leaf arm second end distal to the second plate member connector, and a second saddle extension extending from the second leaf arm proximal the second plate member connector forming a second post saddle with a second concave shape for receiving the post of the thumb frame of the thumb assembly; and a first toolbar fastening portion located at the first leaf arm second end and a second toolbar fastening portion located at the second leaf arm second end.

10. The toolbar of claim 9, wherein the first leaf arm tapers such that a first height of the first leaf arm is narrower at the first leaf arm second end than at the first leaf arm first end, and the second leaf arm tapers such that a second height of the second leaf arm is narrower at the second leaf arm second end than at the second leaf arm first end.

11. The toolbar of claim 9, wherein the toolbar member is a hollow tube.

12. The toolbar of claim 9, wherein the first toolbar fastening portion is a first clearance block joined to the first leaf arm second end and includes a first clearance bore extending there through, and the second toolbar fastening portion is a second clearance block joined to the second leaf arm second end and includes a second clearance bore extending there through.

13. The toolbar of claim 9, wherein the tooling is a ground engaging implement metallurgically bonded to the toolbar member.

14. A thumb frame for a thumb assembly of an implement system for use with a machine, the thumb frame comprising:

a first thumb side wall including a first pivot end and a first saddle end, the first saddle end including a first saddle surface that has a first concave shape;

a second thumb side wall opposite the first thumb side wall, the second thumb side wall including a second pivot end and a second saddle end, the second saddle end including a second saddle surface that has a second concave shape, the first saddle surface and the second saddle surface forming a toolbar saddle for receiving a toolbar member of tooling for the thumb assembly;

a support plate extending between the first thumb side wall and the second thumb side wall;

a stick pin interface located at the first pivot end and the second pivot end;

a post located proximal the toolbar saddle; and a first frame fastening portion located proximal to the first pivot end and extending from an outward facing surface of the first thumb side wall and a second frame fastening portion located proximal to the second pivot end and extending from an outward facing surface of the second thumb side wall.

15. The thumb frame of claim 14, further comprising a linkage interface located between the stick pin interface and the toolbar saddle, wherein the first frame fastening portion is joined to the first thumb side wall between the linkage interface and the stick pin interface, and the second frame fastening portion is joined to the second thumb side wall between the linkage interface and the stick pin interface.

16. The thumb frame of claim 14, wherein the post is a cylinder extending between the first thumb side wall and the second thumb side wall, and wherein the post extends through and protrudes from the first thumb side wall and the second thumb side wall.

17. The thumb frame of claim 14, further comprising a saddle plate extending between the first thumb side wall and the second thumb side wall adjacent to the saddle plate to provide structural support for the toolbar saddle.

* * * * *